US005575070A

United States Patent [19]

Anderson

[11] Patent Number: 5,575,070

[45] Date of Patent: Nov. 19, 1996

[54] KNIFE WITH ADJUSTABLE GUIDE

[75] Inventor: Jerald L. Anderson, Wausau, Wis.

[73] Assignee: Fiskars Inc., Madison, Wis.

[21] Appl. No.: 556,443

[22] Filed: Nov. 9, 1995

[51] Int. Cl.[6] ..... B26B 3/03

[52] U.S. Cl. ..... 30/283; 30/293

[58] Field of Search ..... 30/283, 284, 285, 30/286, 289, 293

[56] References Cited

U.S. PATENT DOCUMENTS

| | | | |
|---|---|---|---|
| 46,244 | 2/1865 | Dow . | |
| 54,170 | 4/1866 | Jones . | |
| 127,998 | 6/1872 | Vickroy . | |
| 605,944 | 6/1898 | Wright . | |
| 1,012,717 | 12/1911 | Saltzman . | |
| 1,069,189 | 8/1913 | Saltzman . | |
| 1,470,147 | 11/1922 | Clawson . | |
| 1,760,575 | 8/1927 | Andersson . | |
| 1,893,113 | 12/1930 | Syfrig . | |
| 2,134,839 | 11/1938 | Perkins | 30/293 |
| 2,301,737 | 5/1942 | Miller . | |
| 2,737,719 | 5/1953 | Ember . | |
| 2,877,551 | 6/1957 | Szekely . | |
| 2,887,552 | 4/1958 | Pollman . | |
| 3,110,964 | 10/1962 | Szekely . | |
| 3,178,817 | 3/1963 | Rubinstein . | |
| 3,191,301 | 6/1965 | Rubinstein | 30/283 |
| 3,262,203 | 7/1966 | Hahn | 30/293 |
| 3,271,855 | 9/1966 | Stolbach | 30/283 |

*Primary Examiner*—Hwei-Siu Payer
*Attorney, Agent, or Firm*—Foley & Lardner

[57] ABSTRACT

A cutting implement with an adjustable guide, such as a knife, includes a handle, an elongated blade, a guide adjustable with respect to the blade, and a knob substantially received in a cavity formed in the upper region of the handle. The knob protrudes from the cavity and cooperates with the guide so that a user can adjust the space between the guide and the blade by rotation of the knob.

20 Claims, 3 Drawing Sheets

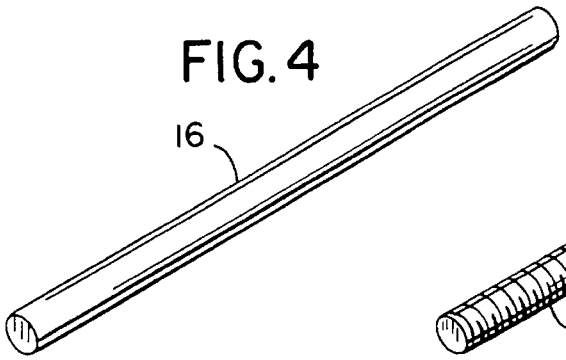
FIG. 4
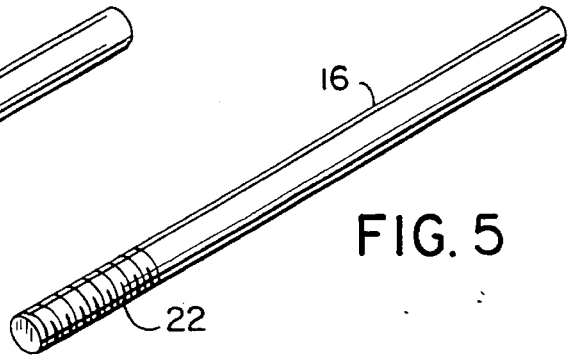
FIG. 5
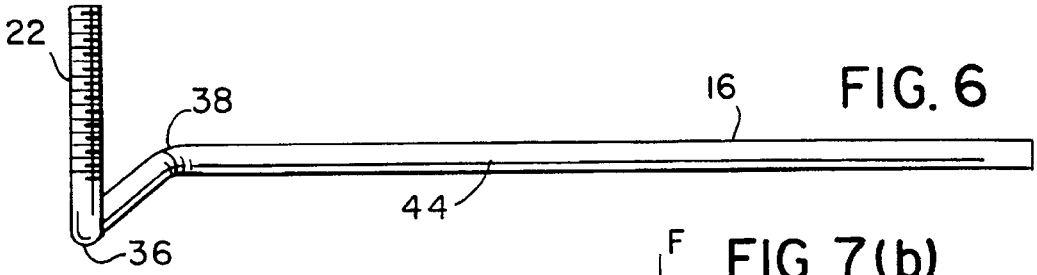
FIG. 6
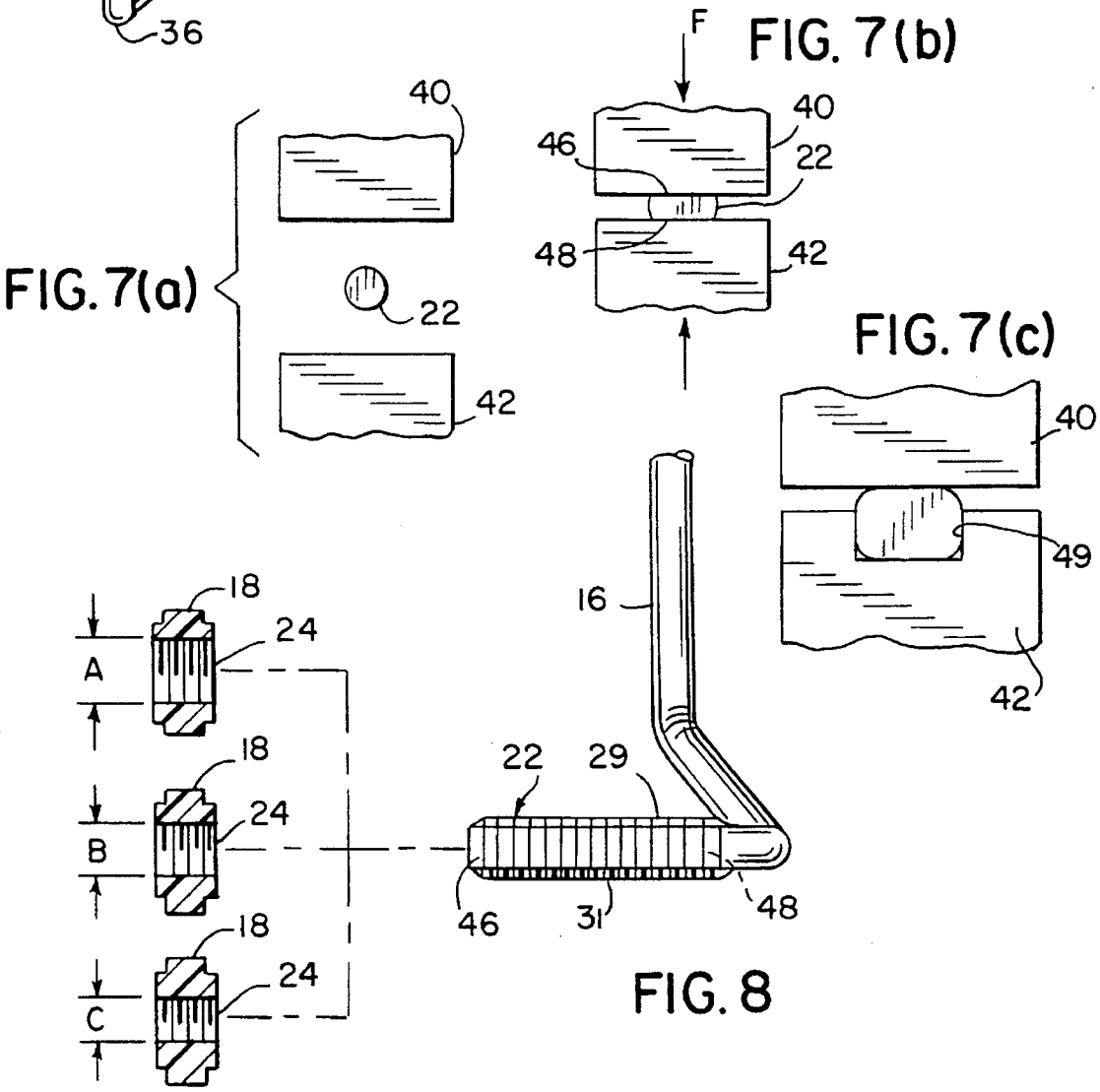
FIG. 7(a)
FIG. 7(b)
FIG. 7(c)
FIG. 8

KNIFE WITH ADJUSTABLE GUIDE

FIELD OF THE INVENTION

The present invention relates generally to cutting implements, such as knives, having an adjustable blade guide.

BACKGROUND OF THE INVENTION

Cutting implements, such as knives, are widely used. For accuracy and uniformity of the slices of food to be cut, certain knives such as bread knives are commonly provided with a guide or gage spaced apart from the blade. Prior art knives having a blade guide generally fall into two categories. Those with the guide attached at two distal points on the blade, and those in which the guide is supported at only one of its ends thereby forming a cantilever beam structure.

An example of a knife having a guide attached at both ends is illustrated in U.S. Pat. No. 127,998 issued Jun. 18, 1872 to Vickory. Vickory discloses a knife having a blade guard which can be placed at discrete positions relative to the blade. While simple in construction, in addition to offering only a limited number of selections to the user, adjusting the spacing between the guard and the blade requires the use of both hands.

Another example of an adjustable knife guide attached at both ends of the blade is illustrated in U.S. Pat. No. 1,470,147 issued Oct. 9, 1923 to Clawson. Clawson discloses a knife having a spring-biased guide extending below the plane of the cutting edge of the knife. This construction allows the user to place the guide in abutting relationship with the food to be sliced. Toward the end of the slicing operation, i.e., when the guide comes into contact with the surface on which the item to be cut is placed, the spring-biased guide yields under the downward force exerted by the user so that the slice can be cut all the way through. Although the spring-biased guide aids the user in positioning the knife relatively accurately with respect to the food to be cut, in order to adjust the spacing between the guide and the blade, the user, using both hands, must remove the fasteners that secure the guide support members to the blade, separate the spring-biased guide from the blade, and insert different size washers between the guide support members and the blade before reattaching the guide to the blade.

In addition to the limitations described above, in knives having a blade guide attached at both ends, the food being sliced has a tendency to get caught between the blade and the guide. Accordingly, to overcome some of these shortcomings, in certain prior knives with adjustable guide the guide is attached to the blade only at the end proximate to the handle. In such cantilever beam construction, disengaging the knife from the item to be cut can be achieve simply by pulling the knife back toward the user. A cantilever-type guide also typically allows the user to adjust the spacing of the guide more conveniently.

U.S. Pat. No. 1,069,189 issued Aug. 5, 1913 to Saltzman discloses a knife having a cantilever guide. The guide is attached to the knife by means of a U-shaped member configured to fit over the top edge of the blade. The U-shaped member includes a stem integrally formed with and extending from the member. The stem is threaded both internally and externally. The internally threaded bore receives a set screw which secures the U-shaped member to the blade. The spacing between the blade and the guide can be adjusted by rotation of a nut mounted onto the externally threaded stem. The nut also has a series of longitudinally extending grooves at spaced locations along its circumference which are designed to receive a spring finger to prevent accidental rotation of the nut.

In Saltzman, to adjust the guide the user, nesting the handle in one hand, first disengages the spring finger from a groove using the other hand and then rotates the nut along the threaded bolt until the guide is at the desired position with respect to the blade. The user then locks the guide into position by engaging the spring finger in a groove of the nut. Although the free end of the guide permits the user to easily remove the cut slices, both hands are required to adjust the guide. As one will readily appreciate from the foregoing, the knife of Saltzman includes a significant number of components. In addition to increasing the cost of such an item, such a structure makes it more difficult for the user to clean the knife and to keep it free of food crumbs and other particles.

U.S. Pat. No. 3,110,964 issued Nov. 19, 1963 to Szekely also discloses a knife with adjustable guide having a free end and a threaded knob at the opposed end of the guide to adjust the spacing between the guide and the blade. The guide mechanism comprises several parts including a housing, a guiding member, a screw assembly and associated components. Furthermore, since the knob is positioned on a side of the handle, the user will more likely need to use both hands to adjust the position of the guide.

Finally, another example of a knife having a cantilever guide is disclosed in U.S. Pat. No. 3,178,817 issued Apr. 20, 1965 to Rubinstein. In Rubinstein, the adjustable guide is secured to a side of the knife handle by a channel-shaped bracket. The guide is provided with an eye at the guided end, the eye being threaded to receive the stem of a screw which is rotatable by means of a knob disposed on the side of the handle. The eye of the blade guide is guided within the channel of the bracket, thereby allowing the user to adjust the spacing between the guide and the blade by rotation of the knob. Because the knob is disposed closer to the handle than in Szekely, adjusting the guide will be somewhat facilitated.

It is apparent from the foregoing that the knives disclosed in Szekely and Rubinstein benefit from the essential advantage afforded by knives with cantilever-type guides, i.e., they permit the user to more conveniently disengage the knife after a slice of food has been cut. Although these knives also facilitate the adjustment of the guide with respect to the handle, the items disclosed in these two patents still suffer from the fact that they include several components which may be relatively difficult to keep clean.

The limitations identified in the foregoing make apparent that prior art knives provided with an adjustable guide are not fully satisfactory. Thus, it appears desirable to provide a knife with a cantilever-type adjustable guide having improved features that alleviate the shortcomings associated with conventional prior items, but which is nevertheless engineered to facilitate its fabrication, at the same time improving, or at least maintaining, its reliability and relatively low cost.

SUMMARY OF THE INVENTION

The present invention features a knife or other cutting instrument such as a hand saw configured to allow the user to cut slices of food (or other substance) of relatively even thickness. According to one aspect of the present invention, the knife comprises a handle, an elongated blade extending from one end of the handle, and a guide spaced apart from, and adjustable with respect to, the blade. The blade guide is formed from a single, unitary, piece of material, preferably a wireform.

According to a preferred embodiment of the invention, the knife with an adjustable blade guide includes a knob substantially received in, but protruding from, a cavity formed in an upper region of the handle. The knob cooperates with the guide for adjustment of the space between the guide and the blade.

BRIEF DESCRIPTION OF THE DRAWINGS

The preferred exemplary embodiment of the invention will hereinafter be described in conjunction with the appended drawings, wherein like numerals denote like elements and:

FIG. 2(*a*) is partial sectional view of the Knife with Adjustable Guide taken along line 2—2 shown in FIG. 1 with the knob and guide removed from the handle;

FIG. 4 is a perspective view of a wire used to form the guide;

FIG. 5 is a perspective view of the wire shown in FIG. 4 on which the threads have been formed;

FIG. 6 is a top plan view of the guide;

FIG. 7(*a*) is a frontal view of the threaded end of the guide positioned between a pair of forming jaws shown in the open position;

FIG. 7(*b*) is a frontal view of the threaded end of the guide with the jaws shown in the closed position to form flat regions onto the guide end;

FIG. 7(*c*) is an enlarged frontal view of the threaded end of the guide received in a pocket formed in one of the jaws;

FIG. 8 is a partial top plan view of the threaded guide and knobs for matching with the formed guide;

DETAILED DESCRIPTION OF A PREFERRED EXEMPLARY EMBODIMENT

Figure 1:
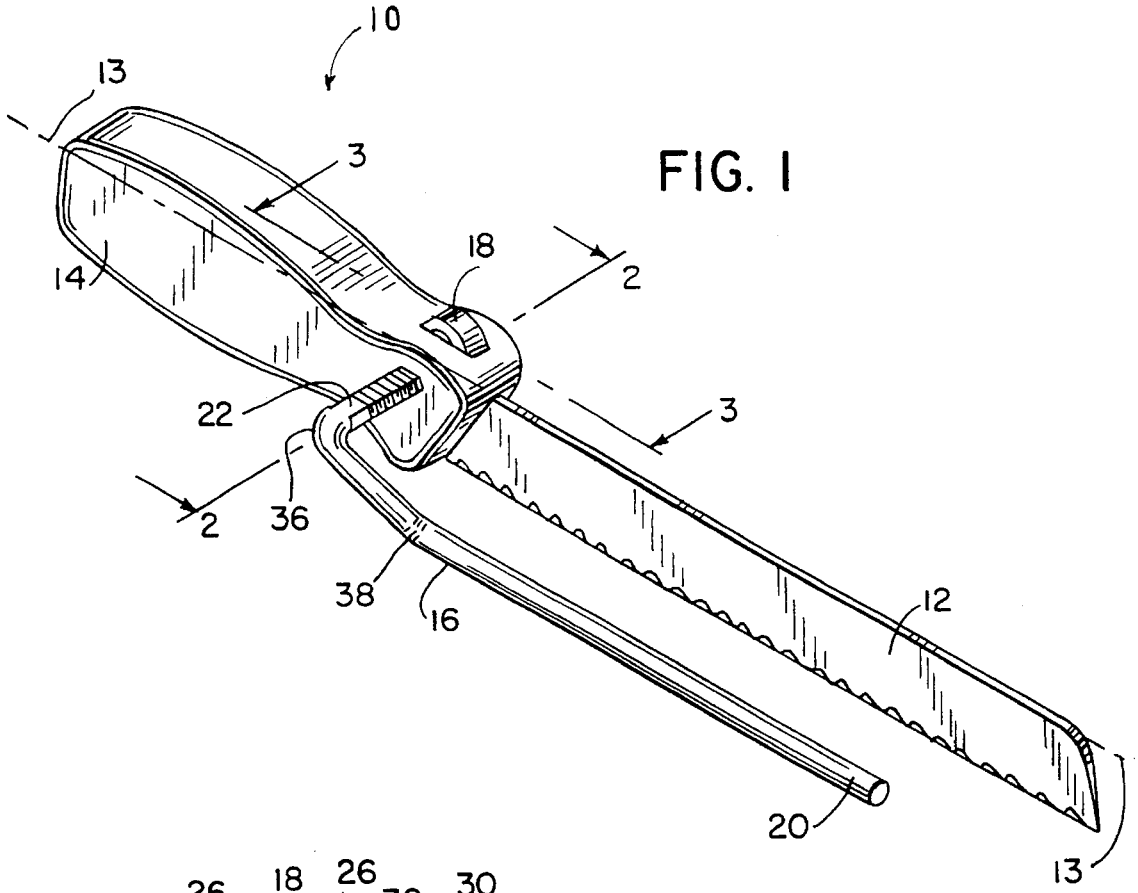
FIG. 1 is a perspective view of a Knife with an Adjustable Guide in accordance with the invention.

The invention relates to cutting implements, such as knives having an adjustable guide in which the adjustable guide is secured to the knife and adjustable with respect to the blade by way of a knob received in an upper region of the handle. Accordingly, the term "knife" as used herein from time to time should also be understood to connote other types of cutting implements such as hand saws, etc. In this vein, those skilled in the art will further appreciate that the device described herein and its principle of operation, as well as the method described herein for manufacturing such item and its principles of implementation, is broadly applicable to a wide variety of cutting implements, and may be adapted to devices and utensils other than knives. Accordingly, while the present invention is hereinafter described with particular reference to a knife with adjustable guide, the skilled artisan will note its many other applications.

Referring to the Figures, a knife 10 according to the invention includes an elongated blade 12 extending along a longitudinal axis 13 and connected to a handle 14. Knife 10 also includes a guide 16 spaced apart from blade 12 and substantially parallel to blade 12. The distance between blade 12 and guide 16 can be adjusted to any desired position by rotation of a knob 18 associated with guide 16 and received in a portion of handle 14 as will be discussed below. Adjustable guide 16 is preferably formed of a single piece of wire also called a wireform. Guide 16 includes a free end 20 and an opposed threaded end 22 which has been flattened as will be explained in greater detail below. In accordance with the present invention, knob 18 includes a threaded central aperture 24 configured to engage end 22.

Figure 2:
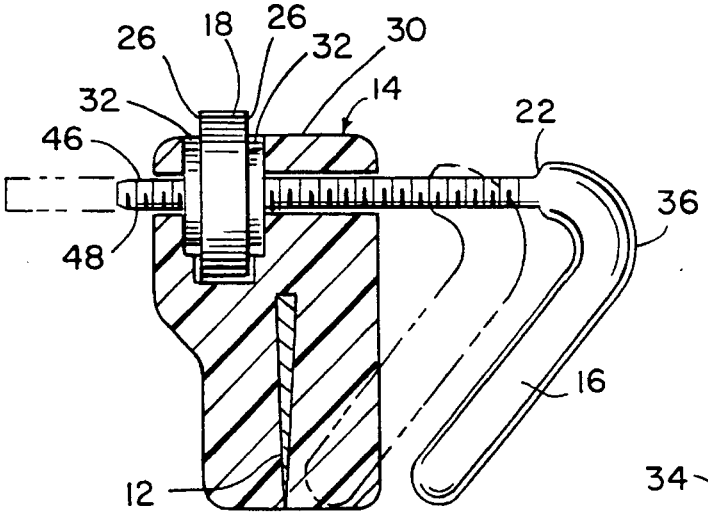
FIG. 2 is a sectional view of the Knife with Adjustable Guide taken along line 2—2 shown in FIG. 1.
Figure 2A:
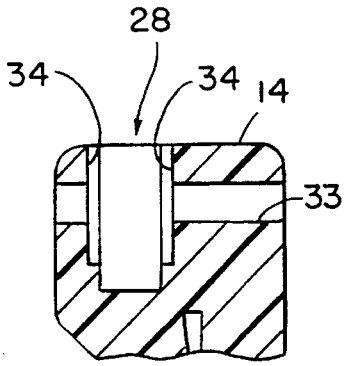
Figure 3:
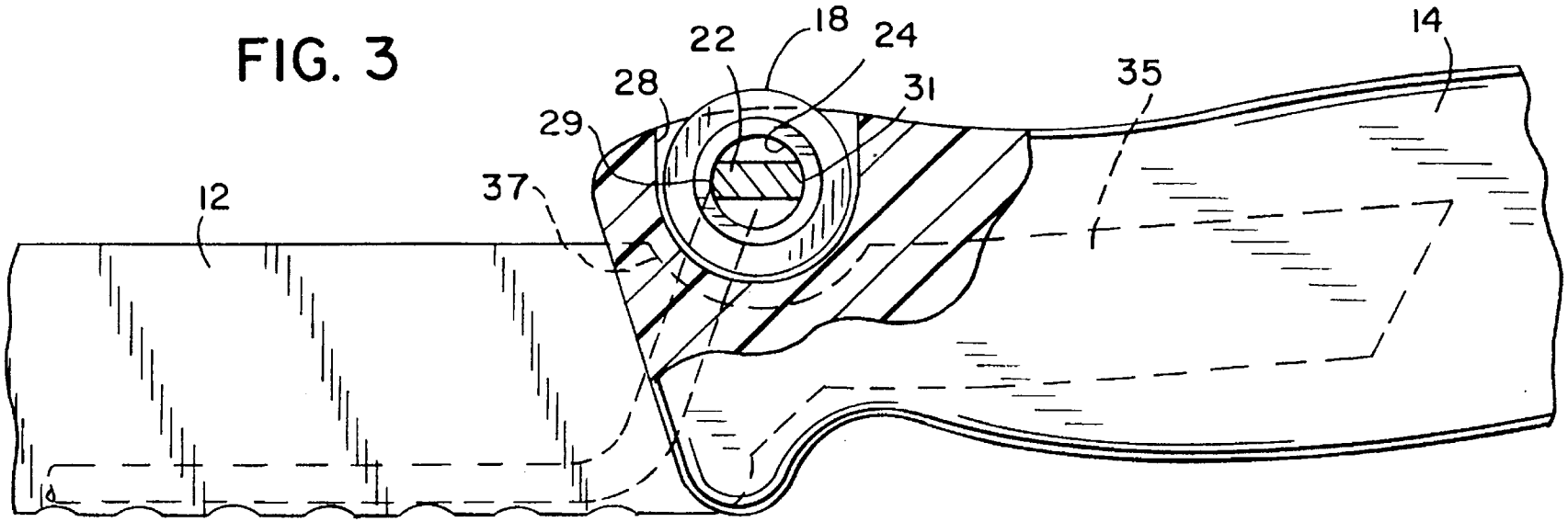
FIG. 3 is a partial sectional view of the Knife with Adjustable Guide taken along line 3—3 shown in FIG. 1.

Referring more particularly to FIGS. 2, 2(*a*), and 3, knob 18 is preferably shaped as a wheel having a pair of oppositely facing and spaced apart sides 26. Knob 18 is substantially received in a cavity 28 formed in a forward region of handle 14. As a result, a portion of knob 18 protrudes above an upper surface 30 of handle 14. Such positioning of knob 18 in cavity 28 allows the user to easily and conveniently adjust the space between blade 12 and guide 16 simply by rotating knob 18 using the thumb of the hand holding the knife, while keeping the knife positioned with respect to the food to be cut.

Because two relatively small threaded sectors 29, 31 only of the circumference of end 22 are effectively engaged by threaded aperture 24, the inventor has noted that when the knob 18 is turned to adjust the spacing between guide 16 and blade 12, knob 18 does not remain fully concentric with end 22. To prevent such undesirable movement of knob 18, knob 18 is guided within cavity 28 by cooperation of shoulders 32, extending from sides 26 of knob 18, with a pair of spaced apart recessed surfaces 34 formed in cavity 28 and extending substantially parallel to axis 13.

For the reasons discussed above in connection with our review of prior art knives, in knives with adjustable guides it is desirable for the guide to be of the cantilever type, i.e., supported and guided only at the end proximate to the handle. However, as those skilled in the art will readily appreciate, undesirable movement of the free end of the guide relative to the blade is typical in knives provided with a cantilever guide. Thus, it is desirable to provide a knife in which the spacing between cantilever guide 16 and blade 12 is maintained along the entire length of guide 16. In other words, it is highly desirable to confine, to an acceptable range, movement of free end 20 toward and away from blade 12.

In the present invention, limiting undesirable movement of free end 20 in other words increasing the stability of guide 16 is provided in two ways. Stability of guide 16 is primarily achieved by having a close fit between flattened threaded end 22 and a bore 33 formed through handle 14 and cavity 28 in a direction perpendicular to axis 13. Bore 33 is configured to provide a close fit with end 22, thereby effectively allowing linear displacement only of guide 16 toward or away from blade 12 as end 22 moves in and out of bore 33.

However, repeated adjustment of guide 16 may, with time, impair the close fit relationship between end 22 and bore 33. Accordingly, undesirable movement of free end 20 is further controlled by effectively positioning knob 18 in cavity 28. To that end, shoulders 32, which as we have seen earlier are functionally guided by recessed surfaces 34 to ensure that knob 18 remains concentric with end 22, are also used to maintain the longitudinal axis of knob 18 (i.e., line 3—3 shown in FIG. 1) in a position substantially parallel to axis 13. Thus, because bore 33 and recessed surfaces 34 cooperate with guide 16 and knob 18, respectively, to effectively prevent undesirable movement of free end 20, all points along guide 16 remain substantially equidistant from blade 12 during a slicing operation, as well as when adjusting the position of guide 16 relative to blade 12.

As in most commercially available knives used with food, handle 14 is advantageously made of plastic. Handle 14 is preferably made of hard molded fiberglass reinforced nylon or the like to improve durability and strength of knife 10, without adversely affecting its weight. Having handle 14 made of moldable material also facilitates positioning bore 33 with respect to axis 13 and recessed surfaces 34 with respect to bore 33, and facilitates forming bore 33 to conform to flattened end 22.

Handle 14 is secured to blade 12 at tang 35. Tang 35 extends along an axis forming an included angle of about seven degrees with axis 13 to raise the fingers of the user away from the cutting surface. Tang 35 also includes a cut-out portion 37 for additional clearance between the bottom of cavity 28 and tang 35, particularly in the event cavity 28 is formed in alignment with blade 12.

The various operations necessary to form guide 16 will now be described with particular reference to FIGS. 4–5. Guide 16 is advantageously made from a unitary piece of material such as a wire. The material used to manufacture guide 16 should be of appropriate hardness so that guide 16 can be supported at end 22 when end 22 is received in bore 33. Stainless steel is preferred, particularly in food applications. After the wire is cut to the desired length, guide 16 is threaded in the region of end 22. In the present invention, the thread pitch is approximately sixteen threads per inch.

Several bends are then formed on guide 16. Referring to FIGS. 1 and 6 and using as a reference plane a plane dividing guide 16 longitudinally in two equal halves, single bend 36 is formed in the region of threaded end 22 by bending guide 16 downwardly, away from the dividing plane. Guide 16 is then bent at compound bend 38 in a direction substantially parallel to the dividing plane, and subsequently rotated so that portion 44, which extends from bend 38 to free end 20, is positioned normal to the direction of threaded end 22. Alternatively, guide 16 can be bent in various other ways to achieve other configurations so long as, when guide 16 is associated with handle 14, a substantial portion of guide 16 extends in a direction substantially parallel to blade 12.

Referring to FIGS. 7(*a*) and 7(*b*), threaded end 22 is then placed between an upper jaw 40 and a lower jaw 42 of a press, with portion 44 being positioned such that it lies in a plane perpendicular to the direction of movement of jaws, 40, 42 which is indicated by arrow F on FIG. 7(*b*). Upper jaw 40 and lower jaw 42 are then closed thereby flattening the threaded region formed at end 22 to form a pair of flat portions 46, 48, joined by oppositely facing sectors 29, 31. Because guide 16 was positioned as described above with respect to the direction of the force applied thereon by the closing of the jaws, flat portions 46, 48 are substantially parallel to the plane of region 44.

Flat portions 46, 48 slidably extend through bore 33 formed in a region of handle 14, with sectors 29, 31 engaging threaded aperture 24 of knob 18. Because flat portions 46, 48 are formed after the threads were formed on end 22, the user is able to conveniently determine and control the displacement of guide 16 relative to blade 12 by looking at the number of threads on end 22 which are guided through, or out of, bore 33. For example, for a thread pitch of 16 threads per inch, a two-thread sliding movement of portion 46 in or out of bore 33 will correspond to a 0.125" displacement of guide 16 with respect to blade 12.

Referring to FIG. 8, to limit manufacturing costs, as noted above, guide 16 is formed from standard wire stock. However, the outside diameter of the wire used to form guide 16 often varies from batch to batch within a given tolerance range due to manufacturing variances. As can be readily appreciated, these variances directly affect the dimensions of end 22. To accommodate such anticipated variations, the present invention advantageously provides several knobs (A, B and C), which differ from one another only by the size of their inside aperture 24. Thus, during the assembling of knife 10, one will select a knob having an aperture 24 of a particular diameter to be matched with a guide of a given nominal diameter.

Referring to FIG. 7(*c*), alternatively and preferably a pocket 49 is formed in the upper region of jaw 42 to control the deformation of threaded end 22. In particular, the width of pocket 49 is sized based on a wire stock having an outside diameter at the lowest end of the dimensional tolerance range and a hardness at the highest end of the hardness range so that region 46, which is formed under the force exerted by the closing of jaws 40, 42, will be sized to match threaded aperture 24. Accordingly, because pocket 49 is sized as discussed here to control the deformation of end 22, even in the case of a wire stock having an outside diameter at the highest end of the dimensional tolerance range and a hardness at the lowest end of that range (i.e., a large but relatively soft wire), region 46 will still be sized to match threaded aperture 24. In other words, the variances of wire 16 will no longer affect the dimensions of end 22.

Figure 9:
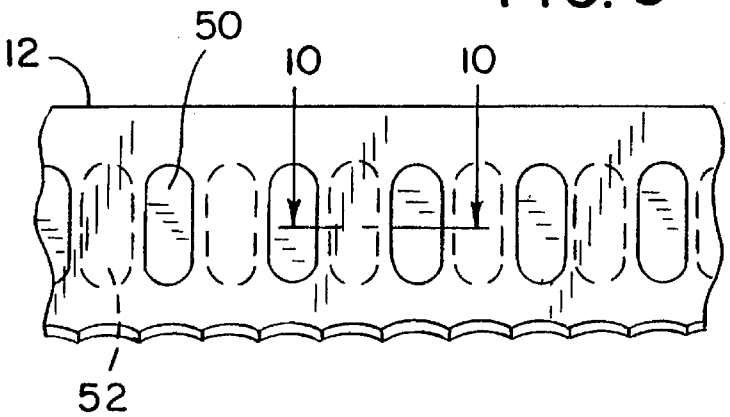
FIG. 9 is a front elevational view of a portion of the blade illustrating the alternating oval recesses.
Figure 10:
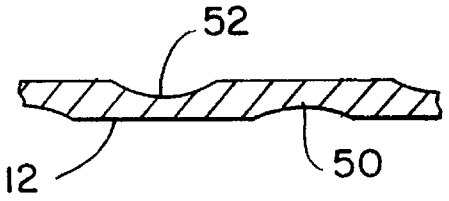
FIG. 10 is a partial sectional view taken along line 10—10 shown in FIG. 9.

Referring to FIGS. 9 and 10, to reduce the surface area of blade 12 which comes into contact with the food or other substance to be sliced, thereby reducing the amount of material which clings to blade 12, blade 12 may also include a plurality of elongated recesses 50 and 52 formed on both sides of blade 12 at alternate positions. The alternation of recesses 50, 52 permits deeper recesses to be formed on both sides of blade 12 without unduly reducing the strength of blade 12. The user is therefore able to cut more easily and accurately because blade 12 does not encounter as much resistance from the material being cut.

It can therefore be appreciated from the foregoing that a knife with adjustable guide according to the present invention alleviates some of the shortcomings typically associated with such prior art knives. In particular the knife of the present invention is of simple construction and relatively low manufacturing cost. Nevertheless, the present invention facilitates adjustment of the guide, improves user comfort, and simplifies cleaning operations. In addition, the shoulders on the knob which are functionally guided in a cavity of the handle together with the flattened threaded portion of the guide being guided through the bore, provide a simple and economical way to increase blade guide stability.

It is understood that the above description is of a preferred exemplary embodiment of the invention, and that the invention is not limited to the specific forms described. Those skilled in the art will appreciate that, for example, cutting implements with adjustable guides in accordance with the invention could comprise a blade other than a knife blade, as in a hand saw. Furthermore, knob 18 could be attached to handle 14 in a manner other than that described in the foregoing, and could, depending on the application, be of other configurations. Likewise, cavity 28 could have a different configuration, as required by the particular knob used therewith. Such modifications and other configurations and constructions are, nevertheless, considered to be within the scope of this invention. Thus, these and other substitutions, modifications, changes and omissions may be made in the design and arrangement of the elements and in the manufacturing steps disclosed herein without departing from the scope of the appended claims.

I claim:

1. A knife with adjustable blade guide comprising:

a handle;

an elongated blade extending from one end of the handle;

a guide adjustable with respect to the blade, the adjustable guide having a portion spaced apart from the blade; and a knob substantially received in, but protruding from, a cavity formed in an upper region of the handle, the knob cooperating with the guide for adjustment of the space between the guide and the blade, the knob being configured as a wheel having a pair of oppositely facing and spaced apart shoulders, and the cavity comprising a pair of spaced apart recessed surfaces formed substantially parallel to the blade, each of the surfaces guiding a respective one of the shoulders when the knob is received in the cavity.

2. The knife of claim 1 wherein the guide has a free end, an opposed end, and at least one bend formed intermediate the portion and the opposed end such that the opposed end is substantially perpendicular to the blade.

3. The knife of claim 1 wherein the knob further includes a central aperture, and the guide has a free end and an opposed end, the central aperture being configured to engage the opposed end.

4. The knife of claim 3 wherein the opposed end has a plurality of threads and the central aperture is threaded to cooperate with the opposed end for displacement of the guide in response to the rotation of the knob.

5. The knife of claim 1 wherein the handle is made of a plastic.

6. The knife of claim 1 wherein the guide has a free end and an opposed end, the portion being intermediate the free end and the opposed end, and wherein the handle has a bore formed therethrough, the bore slidably receiving the opposed end but conforming thereto to increase stability of the free end.

7. The knife of claim 1 wherein the blade has a cutting edge and the guide is at the same level as the cutting edge.

8. The knife of claim 1 wherein the blade has a cutting edge and a tang formed at an angle with respect to the cutting edge.

9. The knife of claim 1 wherein the guide is unitary, formed from a single piece of material.

10. The knife of claim 2 wherein the opposed end and the bend are made of a plastic.

11. A knife comprising:

a handle having a cavity formed in an upper region of the handle and a bore formed through the handle proximate the cavity;

an elongated blade extending from one end of the handle;

a guide having a portion spaced apart from, and adjustable with respect to, the blade and extending substantially parallel thereto, the guide further having a free end and an opposed end disposed on opposite sides of the portion, the opposed end including a pair of spaced apart, threaded, flat portions joined by a pair of oppositely facing threaded sectors, the bore slidably receiving the opposed end but conforming thereto to increase stability of the free end; and a knob substantially received in, but protruding from, the cavity, the knob cooperating with the guide for adjustment of the space between the guide and the blade.

12. The knife of claim 11 wherein the knob is configured as a wheel having a pair of oppositely facing and spaced apart shoulders, and wherein the cavity comprises a pair of spaced apart recessed surfaces extending substantially parallel to the blade, each of the surfaces guiding a respective one of the shoulders when the knob is received in the cavity.

13. The knife of claim 12 wherein the knob further includes a central aperture, the central aperture being configured to engage the opposed end.

14. The knife of claim 11 wherein the guide is unitary, formed from a single piece of material with at least one compound bend so that the portion extends between the bend and the free end.

15. The knife of claim 11 wherein the handle is made of a molded plastic.

16. The knife of claim 11 wherein the opposed end is made of a plastic.

17. A knife comprising:

a handle;

an elongated blade extending from one end of the handle, the blade having a cutting edge;

a cantilever guide adjustable with respect to the blade, the guide having a free end, an opposed end, and a portion extending intermediate the free end and the opposed end, the opposed end having a plurality of threads formed thereon, the handle having a bore formed therein generally perpendicular to the cutting edge; and a knob cooperating with the opposed end for adjustment of the space between the guide and the blade, the knob being configured as a wheel having a pair of oppositely facing and spaced apart shoulders, the knob being received in a cavity formed in the handle, the cavity comprising a pair of spaced apart recessed surfaces extending substantially parallel to the blade, each of the surfaces guiding a respective one of the shoulders when the knob is received in the cavity;

wherein the bore is configured to substantially conform to the opposed end thereby increasing stability of the guide.

18. The knife of claim 17 wherein the opposed end includes a pair of spaced apart, threaded, flat portions joined by a pair of oppositely facing threaded sectors, and wherein the knob further includes a threaded central aperture sized to be matched with and engage the threaded sectors.

19. The knife of claim 17 wherein the handle is made of a molded plastic and the knob is substantially received in, but protrudes from, the cavity.

20. The knife of claim 17 wherein the knob is made of molded plastic.

* * * * *